US005694986A

United States Patent [19]

Weinheimer et al.

[11] Patent Number: 5,694,986

[45] Date of Patent: Dec. 9, 1997

[54] AUTOMATIC ACTUATOR WITH APERTURED HOUSING AND SAFETY INDICATOR

[75] Inventors: Jacek M. Weinheimer, Treasure Island; Lyman W. Fawcett, Jr., St. Petersburg, both of Fla.

[73] Assignee: Halkey-Roberts Corporation, St. Petersburg, Fla.

[21] Appl. No.: 542,421

[22] Filed: Oct. 11, 1995

Related U.S. Application Data

[63] Continuation-in-part of Ser. No. 385,040, Feb. 7, 1995, Pat. No. 5,601,124.

[51] Int. Cl.[6] ..... B63C 9/24

[52] U.S. Cl. ..... 141/19; 141/94; 222/5; 222/54

[58] Field of Search ..... 141/19, 313, 329, 141/348, 384, 114, 94; 222/5, 54, 23, 41, 47; 441/92, 93, 95, 41; 128/202.14, 203.21, 205.21

[56] References Cited

U.S. PATENT DOCUMENTS

| | | | |
|---|---|---|---|
| 3,809,288 | 5/1974 | Mackal | 141/19 |
| 4,267,944 | 5/1981 | Mackal | 222/5 |
| 5,333,656 | 8/1994 | Mackal | 141/19 |
| 5,413,247 | 5/1995 | Glasa | 222/23 |

*Primary Examiner*—Henry J. Recla
*Assistant Examiner*—Steven O. Douglas
*Attorney, Agent, or Firm*—Trexler, Bushnell, Giangiorgi & Blackstone, Ltd.

[57] ABSTRACT

An an inflator for the inflation of inflatable articles such as life vests and the like, such inflator being operated automatically upon being subjected to water as upon the ditching or parachuting of an aviator wearing a life vest provided with such inflator. In the preferred embodiment of the inflator disclosed, the automatic operating portion of it is embodied as an attachment to a known manually operated inflator, the resulting inflator being capable of operation both manually and automatically. The automatic operating portion of the inflator incorporates a releasable blocking device which holds an actuator pin operated by a coil compression spring in cocked condition until the releasable blocking device releases the actuator pin, which thereafter thrusts a piercing pin against and through the sealing diaphragm of a gas-containing capsule. The releasable blocking device is provided with a water destructible element which retains the releasable blocking device in actuator pin cocking position until the water destructible element is submerged in water entering through specially designed apertures. The automatic inflator further includes a color coded indicatior system for indicating the state of the inflator, ready and armed or dispensed and in need of reloading.

10 Claims, 7 Drawing Sheets

10
22
12
32
34
36
18
30
28
24
26
38
62
40
48
50
42
44
46
52
56
74
54
14
58
60
86
82
80
98
16
99
100

6/7

AUTOMATIC ACTUATOR WITH APERTURED HOUSING AND SAFETY INDICATOR

CROSS-REFERENCE TO RELATED APPLICATION

This application is a continuation-in-part application of Ser. No. 08/385,040, now U.S. Pat. No. 05,601,124, filed Feb. 7, 1995.

BACKGROUND OF THE INVENTION

1. Field of the Invention

This invention relates to an automatic inflator for inflatable articles such as life rafts, life vests, and the like. In the disclosed preferred embodiment thereof, the inflator is capable of operation both manually and automatically, the inflator in the latter mode of operation being operated automatically upon its subjection to water.

2. Description of the Background Art

Presently, there exists many types of inflators designed to inflate inflatable articles such as personal floatation devices (life vests, rings and horseshoes), life rafts, buoys and emergency signalling equipment. Inflators typically comprise a body for receiving the neck of a cartridge of compressed gas such as carbon dioxide. A reciprocating piercing pin is disposed within the body of the inflator for piercing the frangible seal of the cartridge to permit compressed gas therein to flow into a manifold assembly of the inflator and then into the article to be inflated. Typically, a manually movable firing lever is operatively connected to the piercing pin such that the piercing pin pierces the frangible seal of the cartridge upon jerking of a ball lanyard. U.S. Pat. No. 3,809,288, the disclosure of which is hereby incorporated by reference herein, illustrates one particular embodiment of a manual inflator.

While manual inflators work suitably well, it was quickly learned that in an emergency situation, the person needing the assistance of the inflatable device, such as a downed aviator, injured person, or a man overboard, would fail or be unable to manually activate the inflator. Accordingly, it was realized that a means should be provided for automatically activating the inflator in such an emergency situation.

In response to this realized inadequacy of the prior art manual inflators, water activated automatic inflators were developed which, when exposed to a fluid such as water, automatically activated the piercing pin of the inflator when immersed in water thereby causing inflation of the inflatable device. Typical water activated automatic inflators comprise a water activated trigger assembly including a water destructible or dissolvable element which retains a spring-loaded actuator pin in a cocked position in alignment with a piercing pin. Upon exposure to water, causing the element to destruct or dissolve, the spring loaded actuator pin is released to forcibly move from the cocked position to an actuated position to strike the piercing pin, either directly or indirectly by devices of an intermediate transfer pin. Upon striking the piercing pin, the pin fractures the seal of the cartridge thereby allowing the gas contained therein to flow into the inflatable device to inflate the same. Representative automatic actuators for inflators are disclosed in U.S. Pat. Nos. 3,059,814, 3,091,782, 3,426,942, 3,579,964, 3,702,014, 3,757,371, 3,910,457, 3,997,079, 4,223,805, 4,267,944, 4,260,075, 4,382,231, 4,436,159, 4,513,248, 4,627,823, and 5,076,468, the disclosures of which are hereby incorporated by reference herein.

While the above referenced automatic inflators operate quite well in inflating inflatable devices in the event of an emergency situation, one major disadvantage to these automatic inflators is their tendency to be prematurely activated in non-emergency situations by errant moisture and water splashes coming into contact with the water destructible or dissolvable element contained in the actuator body. This unwanted water contact was due to the design of the apertures on the actuator bodies utilized in the prior art. The apertures are to facilitate the entering of water into the actuator body during emergency situations, like when an aviator is downed in the ocean, so that the water will contact the destructible or dissolvable element and thereby automatically activate the inflator.

The problem of prematurely and unintentionally activated automatic inflators is so acute that it is not uncommon to be readily replacing the water destructible elements and resetting the automatic inflators on a regular basis when the inflators are constantly stored around water. It is noted that each of the prior art water activated automatic inflators disclosed in the above referenced patents teach a structure which may easily be disassembled to facilitate the replacement of the water destructible element and gas-containing capsule so that the inflator may be reused.

Therefore, it is an object of this invention to provide an improvement which overcomes the aforementioned inadequacies of the prior art devices and provides an improvement which is a significant contribution to the advancement of the inflation art.

Another object of this invention is to provide an automatic inflator that has an actuator body having specially designed apertures so as to preclude errant moisture and water splashes from prematurely activating the automatic inflator in non-emergency situations.

Another object of this invention is to provide an automatic inflator having an actuator body with apertures designed such that the bottom internal side of the apertures are sloped from inward to outward thereby preventing water splashes from entering the actuator body and contacting the water destructible element therein and activating the inflator.

Another object of this invention is to provide an automatic inflator that has an actuator body having an internal means for preventing the water destructible element and actuator pin from twisting relative to each other while resetting and assembling the inflator thereby preserving the pre-release structure of the water destructible element which was being deformed upon initial engagement with the actuator pin upon assembly.

Another object of this invention is to provide an automatic inflator that will only automatically inflate when it is submerged in water.

Another object of this invention is to provide an automatic inflator having an intermediate pin that more securely engages the piercing pin upon the activation of the inflator.

Another object of this invention is to provide an automatic inflator having an intermediate pin that requires less tooling and thereby is more economical to manufacture.

Another object of this invention is to provide an automatic inflator having an actuator pin that is made of a single one piece injection molded structure thereby lessening the cost of manufacturing the automatic inflator.

Another object of this invention is to provide an automatic inflator having a single one piece cylindrical cap that internally movably secures the actuator pin thereby reducing the number of required parts to assemble the inflator.

Another object of this invention is to provide an automatic inflator having a color coded indicator system whereby the status of the inflator, whether armed and ready or dispensed and in need reloading, can be determined by the exposed colors of various components.

Another object of this invention is to provide an automatic inflator for inflating an inflatable article with gas from a gas-containing capsule, comprising in combination: an inflator body including a bore; a means at an upper end of the bore for receiving the gas-containing capsule; a piercing pin assembly which is reciprocatably positioned within the bore; an actuator assembly positioned at a lower end of the bore for actuating the piercing pin assembly to allow gas from the gas-containing capsule to flow into the bore; means for fluidly connecting the bore to the inflatable article; an indicator means for indicating that the gas inflator is armed and ready and, after being used, indicating that the gas inflator has been activated; and the actuator assembly comprising an actuator body having apertures positioned thereon, the apertures being in fluid communication with air passages facilitating access to the actuator assembly, the apertures further having bottom internal surfaces that slope downward, whereby when the inflator is in proper vertical position with the gas-containing capsule facing upwards the bottom internal surfaces of the apertures promote the flow of water splashes away from the air passages so as to allow the entering of water therein when submerged in water, and when not submerged in water, concurrently thereby preventing the entering of inadvertent water therein.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention comprises an automatic inflator that is either manually or water activated. More particularly, the inflator of the invention comprises a cylindrical cap, an actuator body, and an inflator body. The cylindrical cap internally movably contains an actuator pin that is forcibly biased by a compression spring also contained therein. The actuator pin being a single one-piece injection molded unit. The cylindrical cap being secured to the actuator body and thereby engaging the actuator pin with a water destructible element while compressing the compression spring.

The actuator body internally contains an intermediate pin which is forcibly moved forward towards the piercing pin by the actuator pin upon being released by the water destructible element when the inflator is submerged in water. The intermediate pin is selectively adapted to engage the rear end portion of the piercing pin in a more secure fashion so as to better transfer the force of the compression spring to the piercing pin and thereby cause the piercing of the gas-containing capsule.

In addition, the actuator body contains the water destructible element as well as apertures which allow water to enter therein and contact the water destructible element when the inflator is submerged in water.

The inflator body contains the piercing pin, the manual operating means, and a means for securing a gas-containing capsule such that the capsule is pierced by the piercing pin when the inflator is activated.

Additionally, the automatic inflator has a color coded indicator system. When the automatic inflator is armed and ready, only the color green is showing about the inflator indicating that the inflator is armed and ready. Conversely, when the automatic inflator has been activated, only the color red will be showing about the inflator thereby indicating that the inflator is no longer armed and ready.

An important feature of the present invention is that the apertures contained in the actuator body are designed in such a manner as to preclude errant moisture and water splashes from entering the actuator body and causing a unintentional premature activation of the inflator.

Another important feature of the present invention is that the actuator pin is a single one-piece injection molded unit that simplifies the assembly of the inflator and decreases the cost to manufacture the inflator.

Another important feature of the present invention is that the actuator body has internal grooves which engage both the water destructible element and the actuator pin thereby preventing them from twisting relative to each other when resetting and assembling the inflator.

Another important feature of the present invention is that the gas inflator has a color coded indicator system whereby the status of the inflator, whether armed and ready or dispensed and in need reloading, can be determined by the exposed colors of various components.

Therefore, it can be readily appreciated that the present invention precludes premature unintentional activations of the automatic inflator caused by errant moisture and water splashes which frequently occur in the industry.

The foregoing has outlined rather broadly, the more pertinent and prominent features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

Similar reference numerals refer to similar parts throughout the several figures.

DESCRIPTION OF THE PREFERRED EMBODIMENTS

Figure 1:
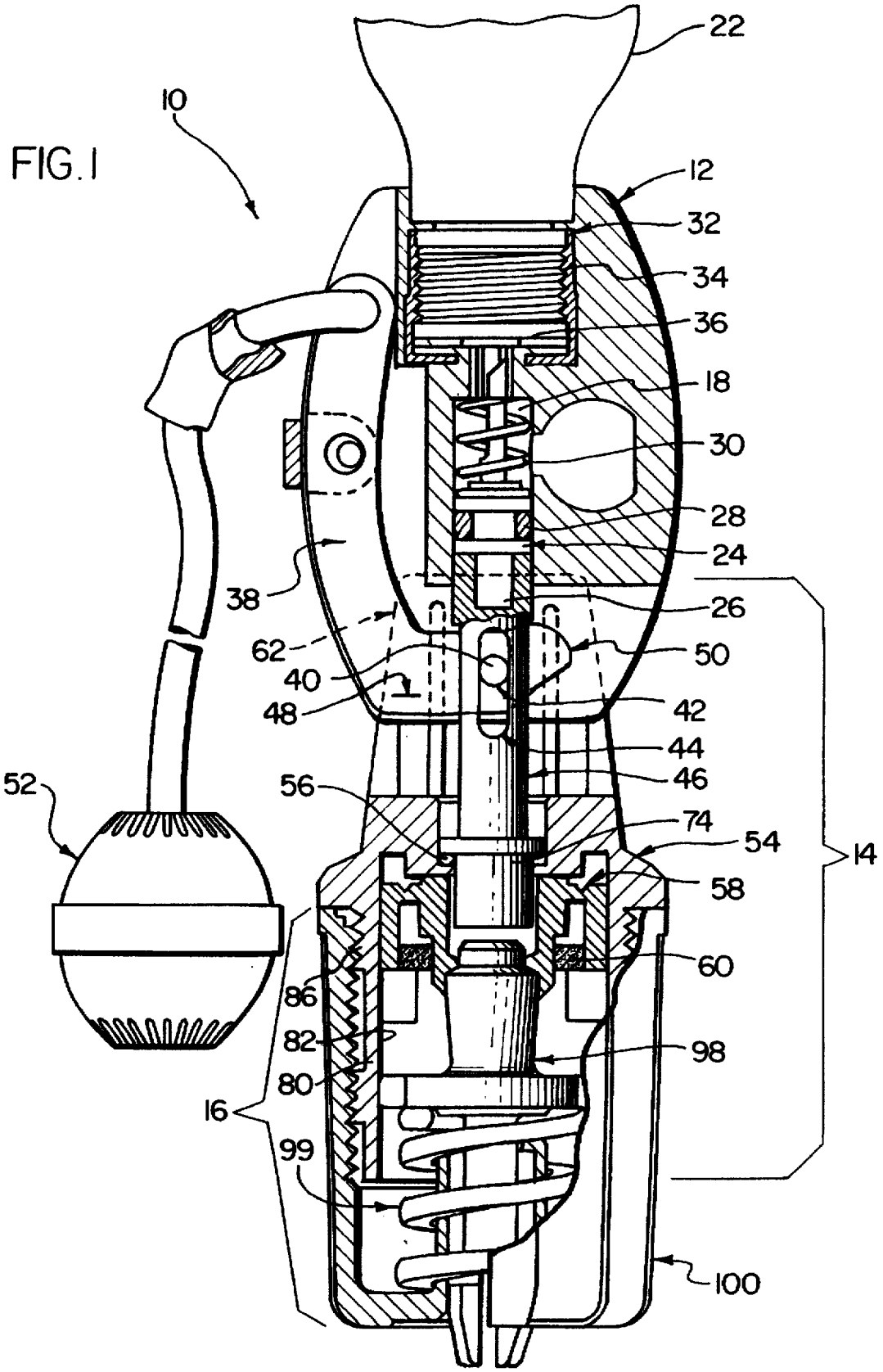
FIG. 1 is a longitudinal cross-sectional view of the automatic inflator assembly showing the various internal parts and their relative position to one another.

As shown in FIG. 1, the automatic inflator 10 of the invention comprises an inflator body 12, an actuator body assembly 14, and a cylindrical cap assembly 16. The inflator body 12 has a general oval shape. Most preferably, the material constituting the inflator body 12 comprises a material such as polyurethane, polyester, or polyether, each of which are known to be commonly used in the industry.

The inflator body 12 has a longitudinal central bore, generally indicated by numeral 18, having an upper end and a lower end and which is sized to receive a piercing pin assembly 20 reciprocatably positioned therein so that a gas-containing capsule 22 is pierced when the piercing pin assembly 20 is forcibly moved towards the capsule 22. The piercing pin assembly 20 comprises a piercing pin 24 having a rear end portion 26, a sealing gasket 28, and a small compression spring 30. A conventional metal insert 32, having interior threads 34 and gasket 36, is molded in situ within the upper portion of the inflator body 12. As seen in phantom in FIG. 1, the gas-containing capsule 22 may be threaded into the metal insert 32. The gasket 36 assures that the gas-containing capsule 22 is sealed within the metal insert 32.

The manual operating means is located on the inflator body 12. As seen in FIG. 1, the manual operating means includes a lever 38, of generally an L-shape, pivotally mounted to the lower portion of the inflator body 12 by a pivot pin 40 which passes through the inflator body 12, a hole 42 located in the lower portion of the lever 38, and a second slot portion 44 of an intermediate pin 46. The lower end portion 48 of the lever 38 has a cam extension 50 which forcibly acts indirectly on the piercing pin assembly 20 when the lever 38 is pulled and thereby causes the gas-containing capsule 22 to be pierced. The second slot portion 44 permitting the longitudinal movement of the intermediate pin 46 relative to the pivot pin 40. A lanyard handle 52 is connected to the lever 38.

The pivot pin 40 fixedly secures the actuator body assembly 14 to the inflator body 12. The actuator body assembly 14 of the invention is generally comprised of an actuator body 54, the intermediate pin 46, a conventional o-ring 56, and a releasable blocking means 58 having a water destructible element 60.

Figure 2:
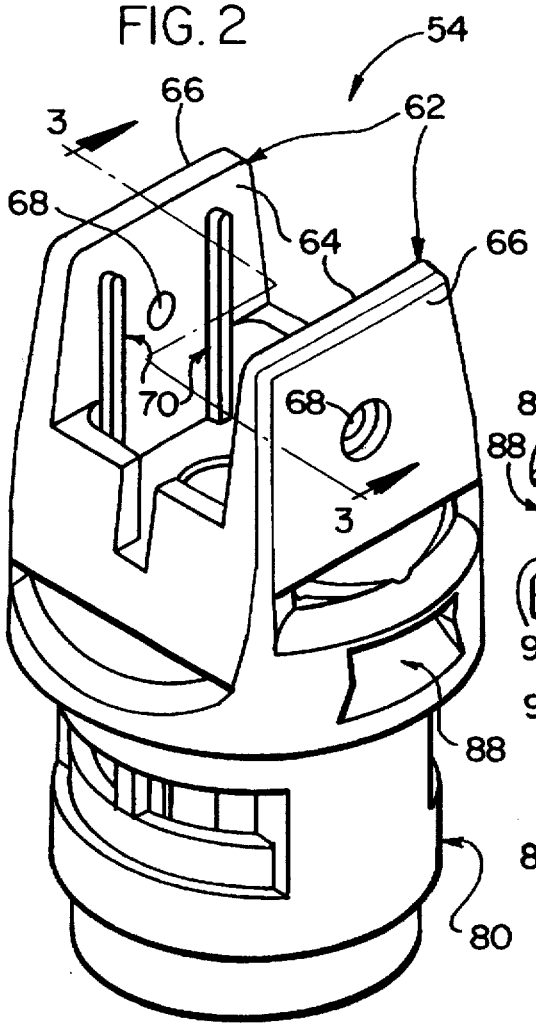
FIG. 2 is an isometric view of the actuator body illustrating the apertures, aligned holes in the parallel arms, and their relative positioning about the actuator body.
Figure 3:
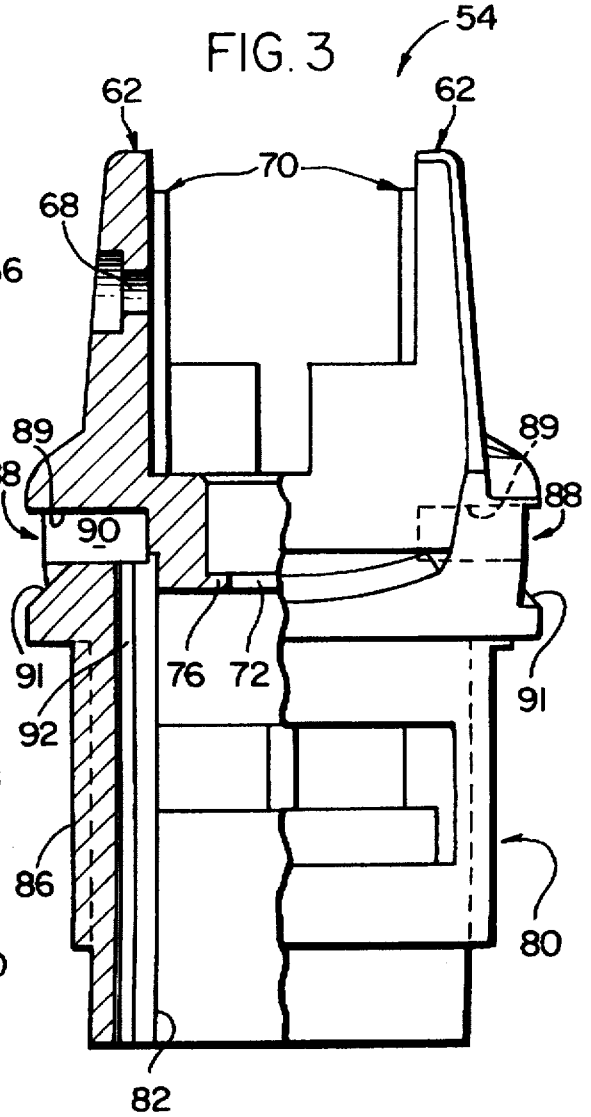
FIG. 3 is a cross-sectional view of FIG. 2 taken along lines 3—3 illustrating the aperture structure and the aperture's bottom internal side design.
Figure 5:
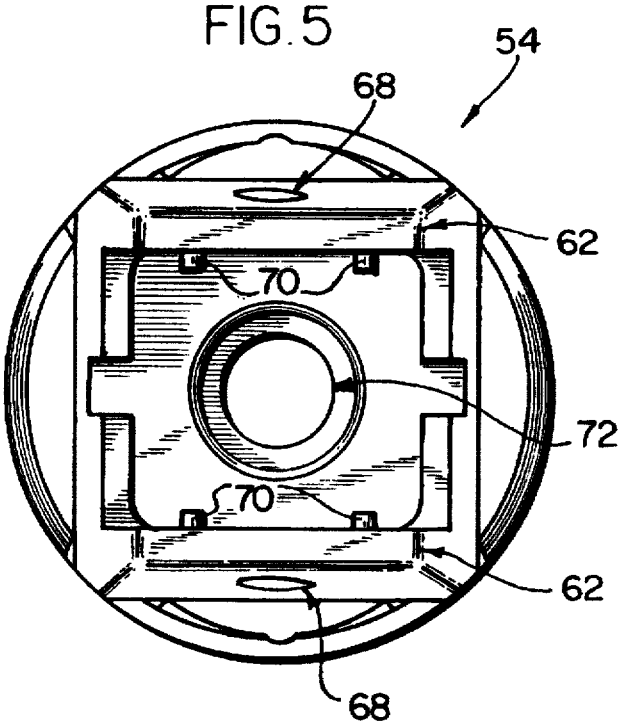
FIG. 5 is a top view of the actuator body showing the central bore and the internal flange that engages the rearward end portion of the intermediate pin.
Figure 6B:
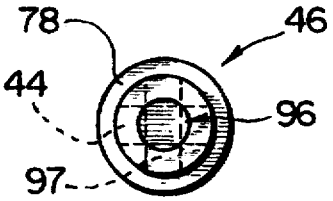
FIG. 6*b* is a forward view of the intermediate pin illustrating how the partial central bore, the first and second slot portions, and the flange relate to each other.

In referring to FIG. 2, the actuator body 54 is of a general circular cylindrical shape having a pair of extending parallel arms 62 which are mirror images of each other and which are spaced apart a distance which only slightly exceeds the thickness of the inflator body 12. The pair of extending parallel arms 62 further include internal surfaces 64, external surfaces 66, and aligned opposing holes 68. The aligned opposing holes 68 receive the pivot pin 40 which facilitates the securing of the actuator body 54 to the inflator body 12. As seen in FIGS. 2, 3, and 5, a pair of stabilizing ridges 70 extend inward from the internal surfaces 64 of each of the extending parallel arms 62 so as to engage the inflator body 12 and prevent any possible pivotal movement by the actuator body 54 relative to the inflator body 12 once fixedly secured to each other.

Figure 4:
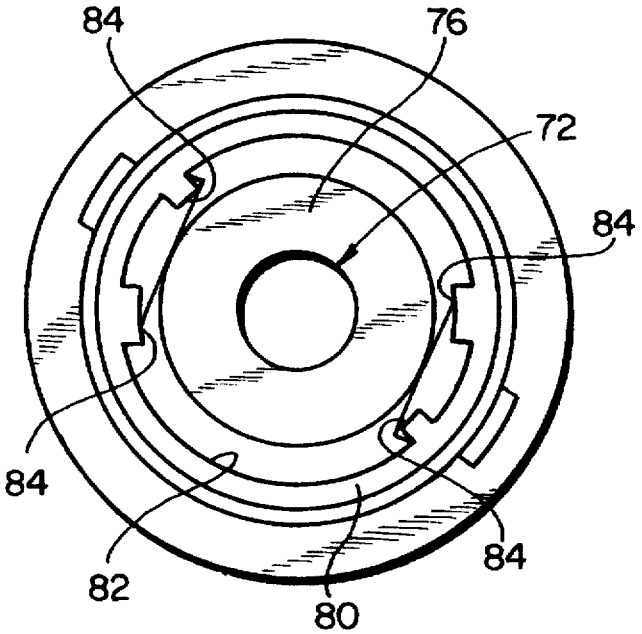
FIG. 4 is a bottom view of the actuator body showing the internal guide grooves on the skirt and the central bore therein.

In referring to FIGS. 4 and 5, it is shown that the actuator body 54 further includes a central bore, generally indicated by numeral 72, for receiving the rearward end portion 74 of the intermediate pin 46. A body flange 76 is located about the central bore 72 that engages a flange 78 on the intermediate pin 46. In FIG. 3, a thin-walled skirt 80 is shown extending longitudinally downward having an internal surface 82 with a plurality of guide grooves 84 extending inward therefrom and external threads 86. The plurality of guide grooves 84 receives the releasable blocking means 58 and thereby prevents the blocking means 58 from turning while in position.

Most importantly, as shown in FIGS. 2 and 3, the actuator body 54 includes apertures 88 positioned upward from the thin-walled skirt 80 and below each of the parallel arms 62. The apertures 88 are generally rectangular in shape and have a top internal surface 89, opposing side internal surfaces 90, and a bottom internal surface 91. The apertures 88 have a specially designed bottom internal surface 91 wherein the bottom internal surface 91 slopes downward causing an increasing dimension of the apertures 88 from inward to outward. Thus, when the automatic inflator 10 is in its proper vertical position with the gas-containing capsule 22 facing upwards, the downward sloping aspect of the bottom internal surfaces 91 of the apertures 88 acts to promote the flow of inadvertent water splashes down, out and away from the air passages 92 located in the upper back of the apertures 88 and to thereby preclude the inadvertent water splashes from prematurely activating the automatic inflator 10 of the apertures 88 acts to preclude inadvertent water splashes from prematurely activating the automatic inflator 10. Additionally, in the back of the apertures 88, air passages 92 are located which provide access to the internal surface 82 of the thin-walled skirt 80.

Figure 6:
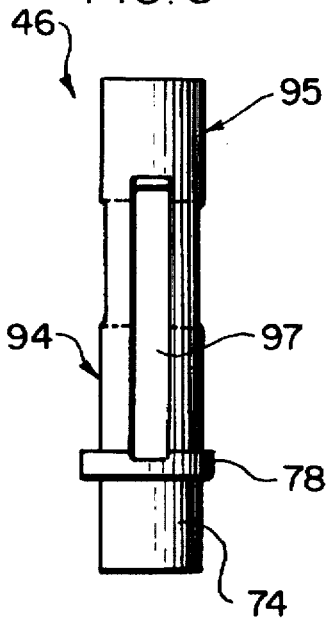
FIG. 6 is a longitudinal plan view of the intermediate pin showing the relative positioning of the first slot portion, the rearward end portion, the flange, and the forward end portion.
Figure 6A:
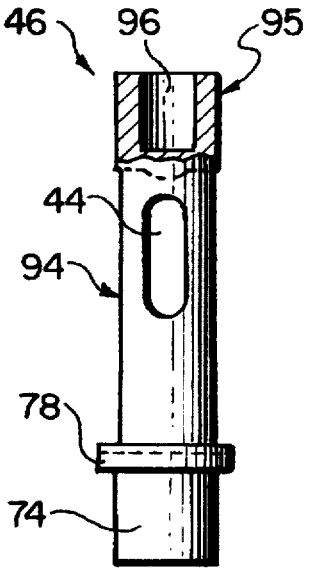
FIG. 6*a* is a longitudinal cross-sectional view of the intermediate pin showing the forward end portion with its partial central bore that receives the rear end portion of the piercing pin, and the relative positioning of the second slot portion.

In now referring to FIGS. 6, 6*a*, and b, the intermediate pin 46 is shown. The intermediate pin 46 is comprised of the rearward end portion 74, a forward circular cylindrical portion 94, and a flange 78 therebetween. The intermediate pin 46 is received by the lower portion of the inflator body 12 and the central bore 72 of the actuator body 54. A conventional O-ring 56 is placed between the flange 78 of the intermediate pin 46 and the body flange 76 of the actuator body 54 thereby forming a seal.

The circular cylindrical portion 94 of the intermediate pin 46 further includes a forward end 95 having a partial central bore 96 therein, a first elongated slot portion 97 extending from the flange 78 to the forward end 95, and a second slot portion 44 perpendicular to the first elongated slot portion 97. The second slot portion 44 is positioned behind and abutting the forward end 95 of the intermediate pin 46 and the intermediate pin 46 is aligned with the piercing pin 24 whereby the forward end 95 confronts and is selectively adapted to engage the rear end portion 26 of the piercing pin 24.

Figure 7:
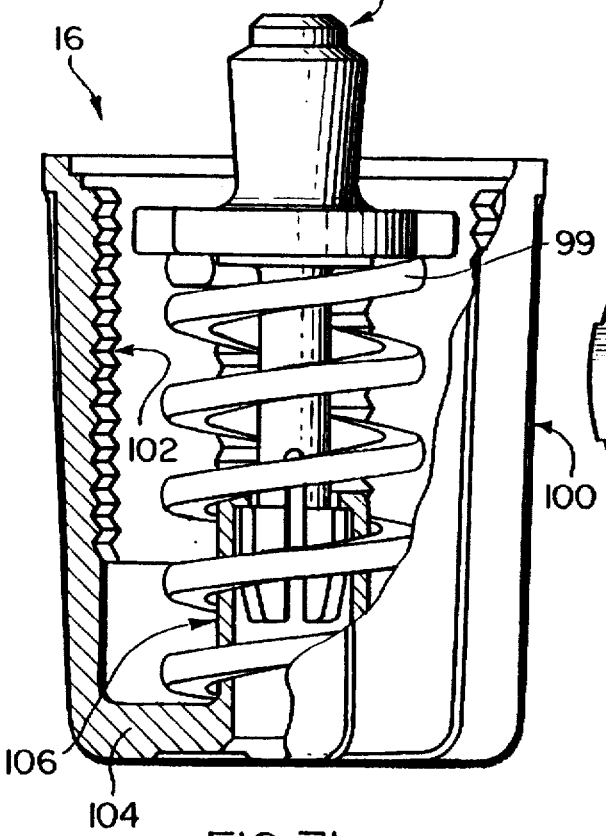
FIG. 7 is a cross-sectional view of the cylindrical cap assembly showing the relative positioning of the actuator pin, the large compression spring, and the cylindrical cap.
Figure 7A:
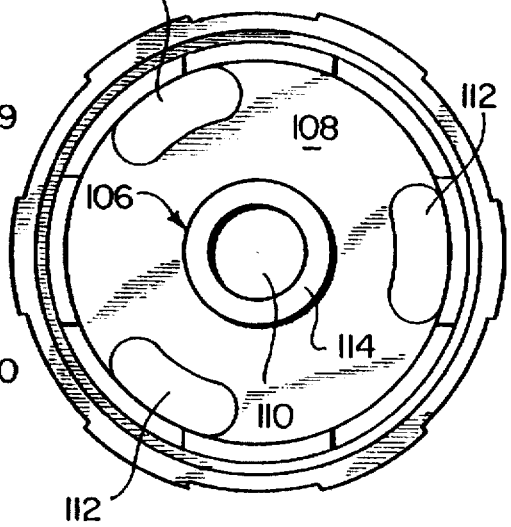
FIG. 7*a* is a top view looking down into the cylindrical cap illustrating the relative positioning of the central hole, the satellite holes and the external fluting.
Figure 7B:
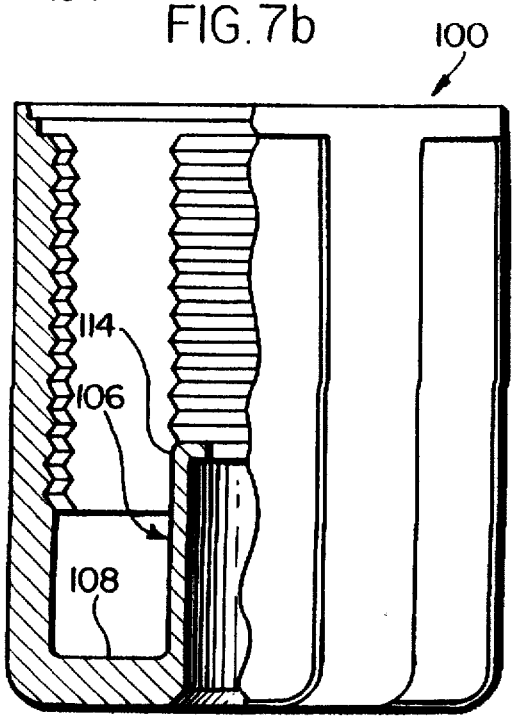
FIG. 7*b* is a cross-sectional view showing the internal cylindrical boss and threads of the cylindrical cap.
Figure 7C:
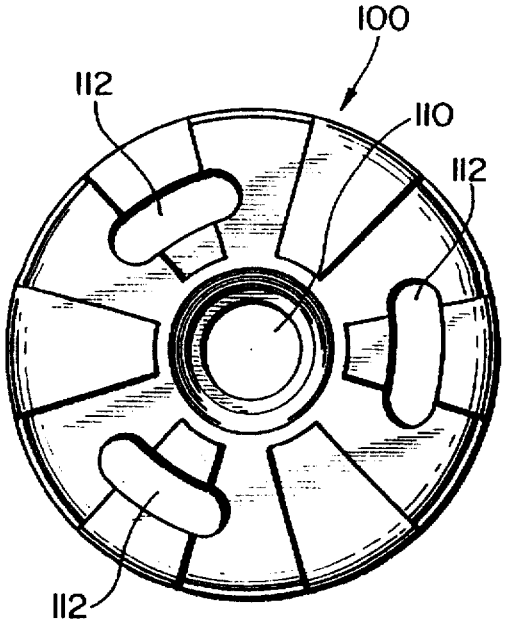
FIG. 7*c* is a bottom view showing the fluting, the central hole, and the internal cylindrical boss end lip of the cylindrical cap.

Now in referring to FIG. 7, the cylindrical cap assembly 16 is shown. The cap assembly 16 comprises an actuator pin 98, a large compression spring 99, and a cylindrical cap 100 having internal screw threads 102, a closed end 104, and an internal cylindrical boss 106. In FIGS. 7*a*, 7*b*, and 7*c*, the cylindrical cap 100 is shown in greater detail to further include an internal end surface 108, a concentrically located hole 110, and evenly spaced satellite holes 112 situated about the concentrically located hole 110. The internal cylindrical boss 106 is concentrically extending from said internal end surface 108 about the concentrically located hole 110. The internal cylindrical boss 106 further comprises a boss end lip 114 protruding radially inward.

Figure 8:
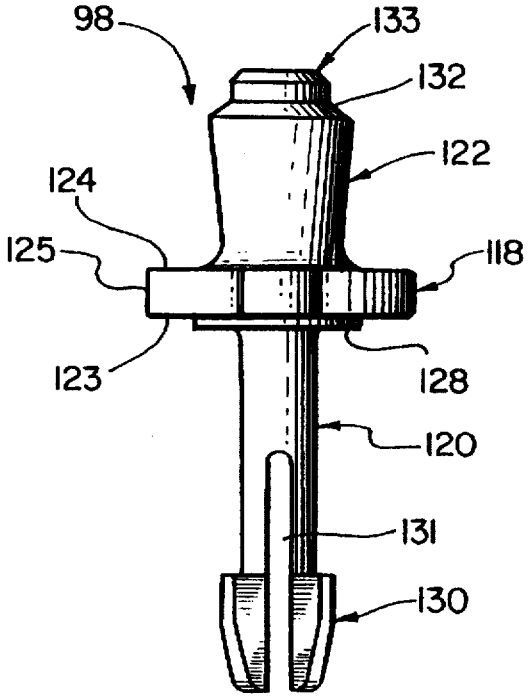
FIG. 8 is a longitudinal view of the actuator pin showing the circular flat head portion, the actuator head, and the frustro conical end portion relative to each other.
Figure 8A:
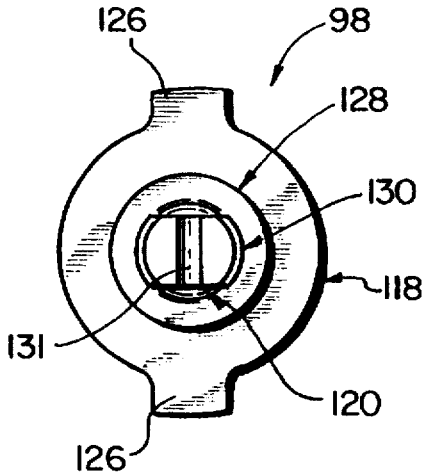
FIG. 8*a* is a bottom view of the actuator pin showing the pair of radially protruding opposed edge tabs on the circular flat head portion.

Now, in referring to FIGS. 8 and 8*a*, the actuator pin 98 can be seen in greater detail. The actuator pin 98 extends longitudinally and centrally having a circular flat head portion 118, a circular cylindrical stem portion 120, and an actuator head 122. The actuator pin 98 is a single injection molded unit that is made out of a material such as polycarbonate or polyurethane (polyester- or polyether-based), each of which are readily known in the industry and used in injection mold processes. The circular flat head portion 118 further includes a back side 123, a front side 124, and a radial edge 125 therebetween, a pair of radially protruding opposed edge tabs 126, and a spring seat step portion 128 extending from the back side 123.

As seen in FIG. 8, the circular cylindrical stem portion 120 extends centrally from the spring seat step portion 128. The circular cylindrical stem portion 120 includes a frustro conical end portion 130, and an elongated slot 131 extending through said frustro conical end portion 130 and into a portion of said stem portion 120. This elongated slot 131 facilitates the flexing of the frustro conical end portion 130 when engaging the internal cylindrical boss 106 and the internal boss end lip 114 in the cylindrical cap 100.

The actuator head 122 longitudinally centrally extends from the front side 124 of the circular flat head portion 118. The actuator head 122 further includes an engaging end 132 having a guide nipple 133 extending longitudinally and centrally therefrom. The actuator head 122 has an increasing diameter from the front side 124 of the circular flat head portion 118 to the engaging end 132.

Upon assembly of the automatic inflator 10, the engaging end 132 and guide nipple 133 of the actuator pin 98 are received by the releasable blocking means 58 within the actuator body 54, as seen in FIG. 1. The pair of radially protruding opposed edge tabs 126 of the circular flat head portion 118 thereby engage the plurality of guide grooves 84 in the thin-walled skirt 80 to prevent the actuator pin 98 and releasable blocking means 58 from twisting relative to each other when assembling the automatic inflator 10.

In referring back to FIG. 7, the highly conventional large compression spring 99 having an internal diameter significantly larger than the external diameter of the internal cylindrical boss 106 is concentrically positioned around the same. The large compression spring 99 is positioned between the closed end 104 of the cylindrical cap 100 and the back side 123 of the flat head portion 118 of the actuator pin 98. The large compression spring 99 is oriented on the flat head portion 118 by engaging the spring seat step portion 128. The frustro conical end portion 130 of the actuator pin 98 is centrally inserted through the large compression spring 99 along its longitudinal axis and forcibly received by the internal cylindrical boss 106. The frustro conical end portion 130 is thereby held in position by engaging said internal boss end lip 114.

In assembling the automatic inflator 10 as is illustrated in FIG. 1, the cylindrical cap 100 is threadedly engaged with the thin-walled skirt 80 on the cylindrical actuator body 54. The actuator pin 98, guided by the guide grooves 84 engaging the radially protruding opposed edge tabs 126 of the circular flat head portion 118, is received by the releasable blocking means 58 positioned in the actuator body 54.

Figure 1A:
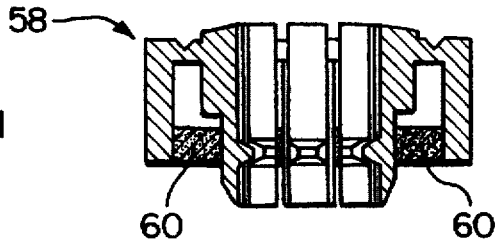
FIG. 1*a* is an enlarged cross-sectional view of the releasable blocking means showing the relative position of the water destructible element within.

The releasable blocking means 58 retains the actuator pin 98 at a constant position while the actuator body assembly 14 threadingly engages the cylindrical cap assembly 16 so as to cause the large compression spring 99 to compress and thereby buildup a stored energy. Whereupon when the automatic inflator 10 is subjected to water, the water destructible element 60 in the releasable blocking means 58 (refer to FIG. 1*a*) deteriorates so as to cause the releasable blocking means 58 to release the actuator pin 98. The actuator pin 98 is then forcibly thrust toward the intermediate pin 46 due to the large compression spring 99 expending its stored energy. The intermediate pin 46 then, in turn, is forcibly thrust toward the piercing pin 24 which thereby pierces the gas-containing capsule 22.

Figure 9:
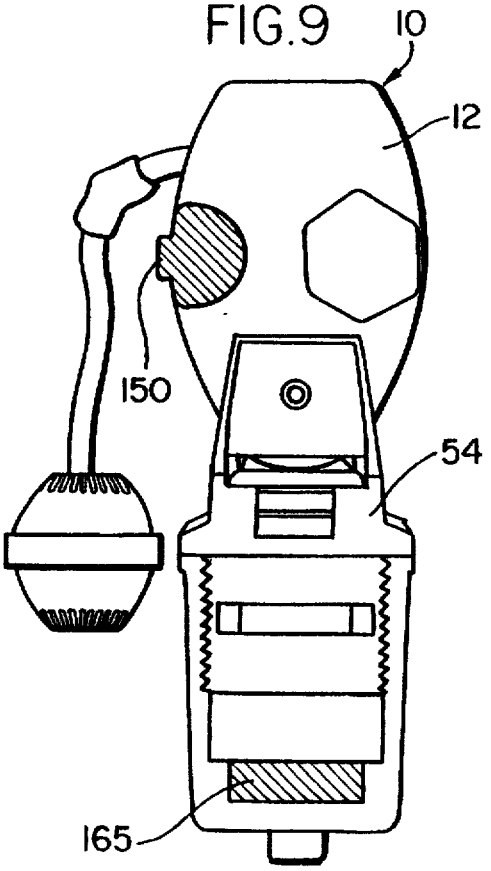
FIGS. 9, 10, and 11 are, respectively, front views of the automatic actuator with the transparent cylindrical cap placed over the apertured housing showing the safety clip in position and the indicator sleeve exposed, the safety clip removed exposing the internally red colored cut portion with the indicator sleeve still exposed, and the safety clip in position with the red colored large compression spring exposed indicating a firing.
Figure 10:
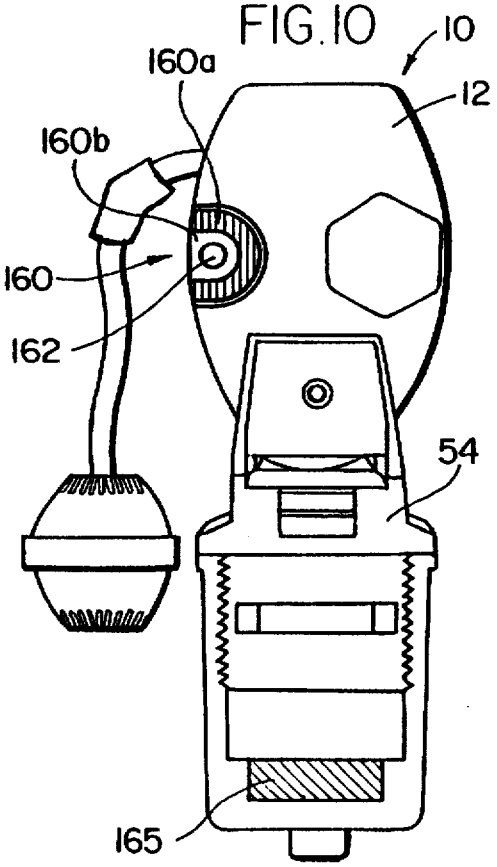
Figure 11:
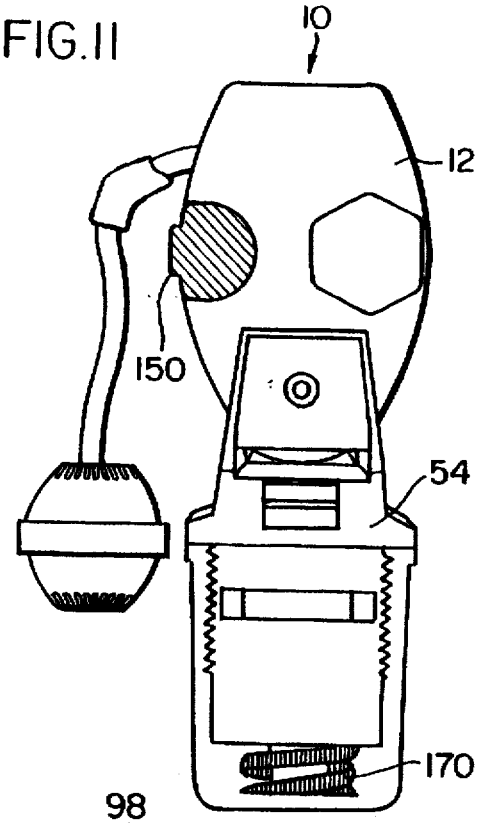

In now referring to FIGS. 9, 10 and 11, an alternate embodiment of the automatic actuator 10 can be seen wherein a color coded indicating system is utilized. The indicating system is comprised of a green colored safety clip 150, a first and second cut portion 160, 161 each having a respective red colored internal surface 160*a*, 161*a*, a green colored indicator sleeve 165, a red colored large compression spring 170 and a transparent cylindrical cap 175.

Figure 12:
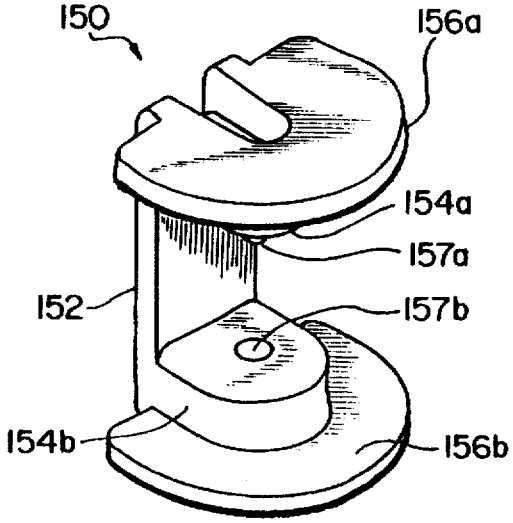
FIG. 12 is an isometric view of the safety clip showing the clip body, the clip ends and the end flange portions in their relative positions.

In referring to FIG. 12, the safety clip 150 includes a longitudinal clip body 152 having in-turned clip ends 154*a*, 154*b*. The in-turned clip ends 154*a*, 154*b* each include a respective flange portion 156*a*, 156*b* that extends radially outward. Further, internal securing protrusions 157*a*, 157*b* are positioned on the in-turned clip ends 154*a*, 154*b* respectively. The safety clip 150 is received by the first and second cut portions 160, 161 located on the inflator body 12.

Figure 15:
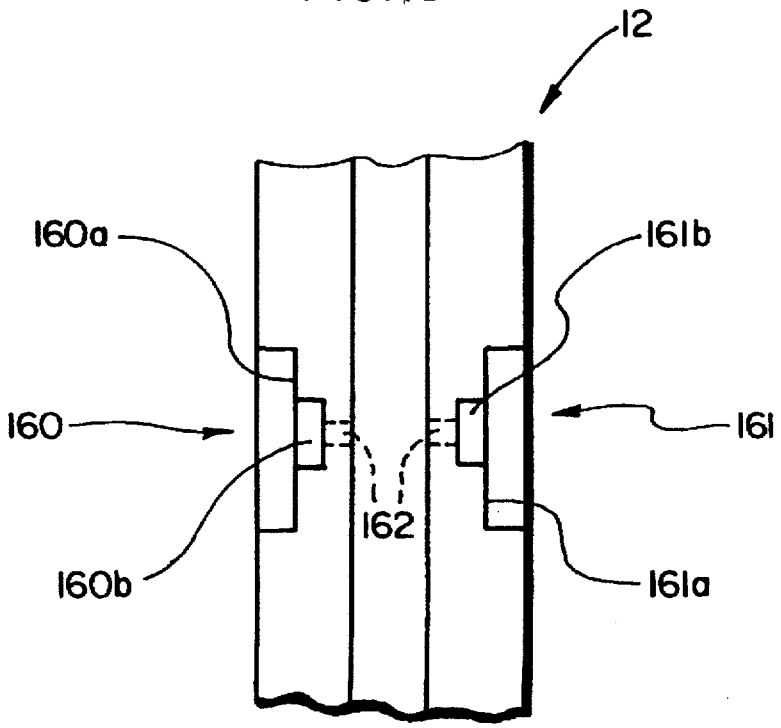
FIG. 15 is a partial side view of the inflator body showing the first and second cut portions, the central channels and the centrally located hole therethrough in their relative positions.

Now, in referring to FIG. 15, the first and second cut portions 160, 161 can be seen. Each of the first and second cut portions 160, 161 include red internal surfaces 160*a*, 161*a* respectively. Within each first and second cut portion 160, 161, central channels 160*b*, 161*b* are respectively positioned. The central channels 160*b*, 161*b* serve to slidingly receive the in-turned clip ends 154*a*, 154*b* of the safety clip 150 respectively. The central channels 160*b*, 161*b* further include a centrally located hole 162.

The safety clip 150 slidingly engages with the first and second cut portions 160, 161 of the inflator body 12 to secure the lever 38 in a closed position therein (see FIGS. 11, 12 and 15). When engaging the first and second cut portions 160, 161, the in-turned clip ends 154*a*, 154*b* of the safety clip 150 are received by the respective central channels 160*a*, 160*b*whereby the internal securing protrusions 157*a*, 157*b* frictionly engage the centrally located holes 162 in the central channels 160*a*, 160*b*. Thus, when the safety clip 150 is in place, its green color shows to indicate that the lever 38 has not been engaged.

Figure 13A:
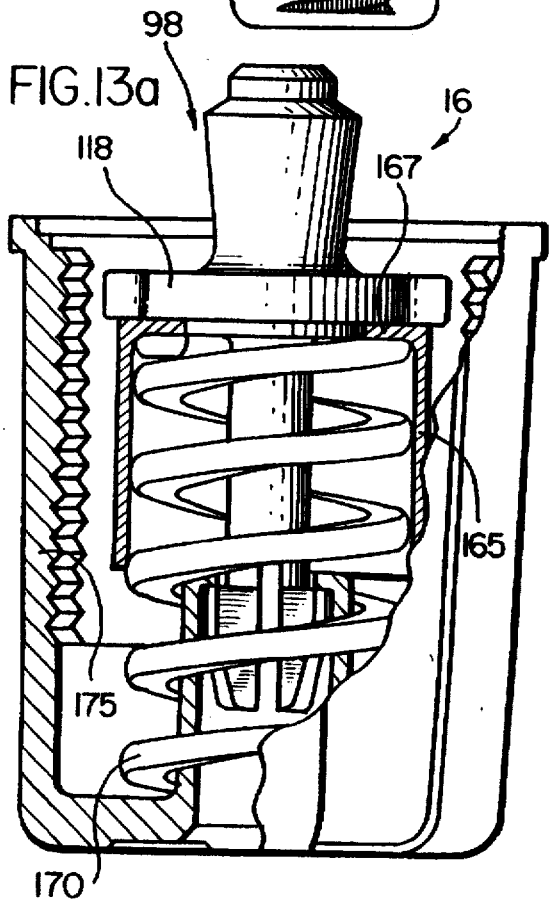
FIGS. 13*a* and 13*b* are cross sectional views of the cylindrical cap assembly showing the indicator sleeve in its relative position to the large compression spring and actuator pin.
Figure 13B:
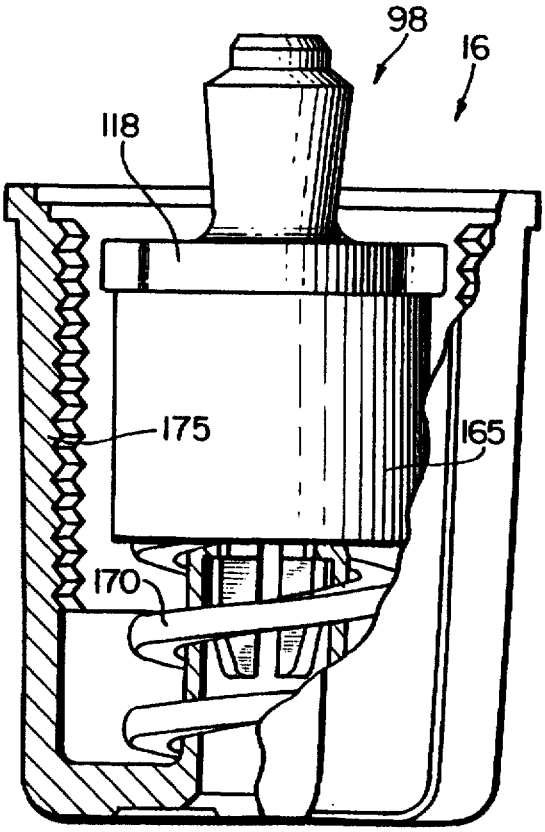
Figure 14:
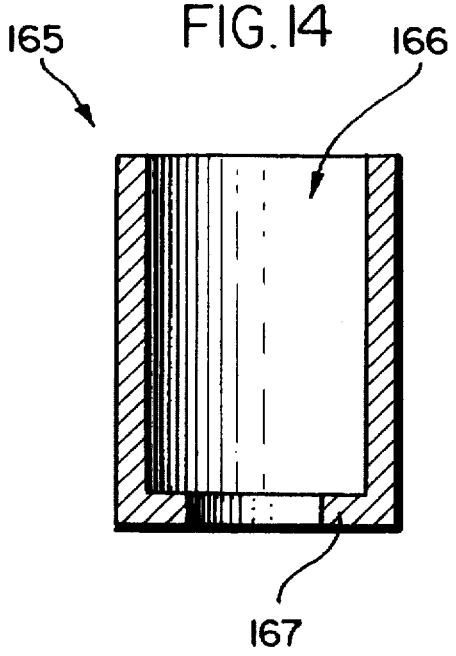
FIG. 14 is a cross-sectional view of the indicator sleeve showing open end and the opposite end having an in-turned radial flange.
Figure 14A:
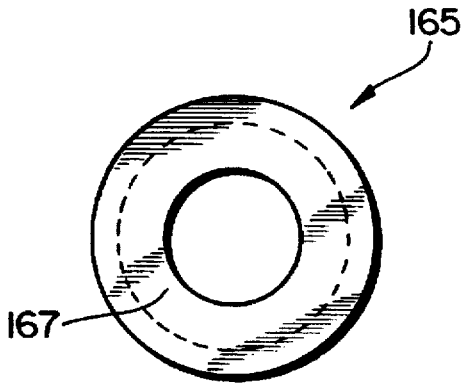
FIG. 14*a* is a bottom view of the of the indicator sleeve showing its cylindrical shape and integral in-turned radial flange.

In referring now to FIGS. 13*a* and 13*b*, the cylindrical cap assembly can be seen with the indicator sleeve in position. Within the transparent cylindrical cap 175, the green colored indicator sleeve 165 is positioned so to surround the red colored large compression spring 170. The indicator sleeve 165 is cylindrical in shape and hollow so to receive the large compression spring 170 and actuator pin 98 therein. The indicator sleeve 165 includes an open end 166 and an in-turned radial flange 167 at an opposite end 168 (see FIGS. 14 and 14*a*). The in-turned radial flange 167 contacts the back side 123 of the circular flat head portion 118 on the actuator pin 98. The in-turned radial flange 167 is interposed between the large compression spring 170 and the circular flat head portion 118 of the actuator pin 98.

The indicator sleeve 165, being green in color and extending out from the actuator body 54 when the automatic inflator 10 is armed and ready, serves to cover the red large compression spring 170 and expose only a green color to an observer so to indicate that the automatic inflator 10 is armed and ready (see FIGS. 9, 10 and 11). When the automatic inflator 10 has been activated, the large compression spring 170 forcibly moves the actuator pin 98 and indicator sleeve 165 simultaneously along the longitudinal axis of the automatic inflator 10 so that the indicator sleeve 165 retracts inside the thin-walled skirt 80 of the actuator body 54. In doing so, the indicator sleeve 165 is resultingly hidden and the red colored large compression spring 170 is exposed (see FIG. 11). Thus, only the color red can be seen by an observer indicating that the automatic inflator 10 has been activated. The green colored indicator sleeve 165 and red large compression spring 170 are both visible through the transparent cylindrical cap 175 when indicating the status of the automatic inflator 10.

Therefore, in operation when the automatic inflator 10 is armed and ready, only the color green should be exposed. Conversely, when the automatic inflator 10 has been activated, the safety clip 150 is removed thereby exposing the red colored internal surfaces 160*a*, 161*a* of the first and second cut portions 160, 161 respectively. Concurrently therewith, the green colored indicator sleeve 165 retracts into the actuator body 54 thereby exposing the red colored large compression spring 170. Thus, when the automatic inflator has been activated, only the color red is exposed indicating that the inflator is no longer armed and ready.

The present invention includes that contained in the appended claims as well as that of the foregoing description. Although this description has been described in its preferred form with a certain degree of particularity , it should be understood that the present disclosure of the preferred form has been made only by way of example and that numerous changes in the details of construction, combination, or arrangement of parts thereof may be resorted to without departing from the spirit and scope of the invention.

Now that the invention has been described,

What is claimed is:

1. A gas inflator for inflating an inflatable article with gas from a gas-containing capsule, the inflator being selectively operable either manually or automatically upon its subjection to water, comprising in combination;

an inflator body including a bore; a means at one end of the bore for receiving the gas-containing capsule; a piercing pin assembly which is reciprocatably positioned within the bore; an actuator assembly including an actuator pin positioned at the opposite end of the bore for displacement through the bore to activate the piercing pin assembly to allow gas from the gas-containing capsule to flow into the bore; means for fluidly connecting the bore to the inflatable article; and an indicator structure for indicating that said gas inflator is armed and ready and, after being used, indicating that said gas inflator has been activated, said indicator structure comprising a first indicator member mounted for movement on said actuator pin and a second indicator member, said first indicator member being movable on said actuator pin between first position in which the first indicator member conceals said second indicator member, and a second position in which said first indicator member is displaced out of visibility to reveal visibility of said second indicator member to serve as indicia of said second position of said first indicator member.

2. A gas inflator as recited in claim 1 wherein said first indicator member comprises a radially outer surrounding sleeve concealing at least a relatively radially inner portion of said second indicator member in said first position of said first indicator member.

3. A gas inflator as recited in claim 1 further comprising a window structure formed in said inflator body and located for alternative visibility therethrough of said first indicator member in said first position thereof, and visibility of said second indicator member when said first indicator member is in said second position thereof.

4. A gas inflator for inflating an inflatable article with gas from a gas-containing capsule, the inflator being selectively operable either manually or automatically upon its subjection to water, comprising in combination;

an inflator body including a bore; a means at one end of the bore for receiving the gas-containing capsule; a piercing pin assembly which is reciprocatably positioned within the bore; an actuator assembly positioned at the opposite end of the bore for actuating the piercing pin assembly to allow gas from the gas-containing capsule to flow into the bore; means for fluidly connecting the bore to the inflatable article; and an indicator means for indicating that said gas inflator is armed and ready and, after being used, indicating that said gas inflator has been activated wherein said indicator means further comprises a first and a second cut portion positioned on said inflator body, a safety clip removably coupled to said inflator body at said first and second cut portions, a large compression spring, and a indicator sleeve having an open end and an opposite end, said indicator sleeve being fitted over said large compression spring and secured to said flat head portion of said actuator pin, whereby said indicator sleeve surrounds said large compression spring so to facilitate said large compression spring being contained within said sleeve when said gas inflator is armed and ready, and subsequently extending out therefrom when said gas inflator has been activated.

5. A gas inflator as recited in claim 4, wherein said sleeve includes an in-turned radial flange integrally extending from said opposite end, said in-turned radial flange being interposed between said large compression spring and said flat head portion of said actuator pin.

6. A gas inflator as recited in claim 5, wherein each of said first and second cut portions further comprise a central channel and a hole centrally positioned within each said central channel.

7. A gas inflator as recited in claim 6, wherein said safety clip includes a longitudinal clip body having in-turned clip ends, said in-turned clip ends each having a flange portion extending radially outward therefrom and internal securing protrusions positioned thereon, whereby said in-turned clip ends are received by said central channels of said first and second cut portions and said internal securing protrusions frictionly engage said hole centrally positioned within each of said central channels.

8. A gas inflator as recited in claim 7, wherein said color coded safety clip and said color coded sleeve are green, and said color coded large compression spring and said first and second cut portions are red.

9. A gas inflator for inflating an inflatable article with gas from a gas-containing capsule, the inflator comprising:

an inflator body having a receptacle structure for receiving a gas-containing capsule;

a releasing structure arranged on said inflator body to actuate release of gas from the capsule, said releasing structure including a manually movable actuator member manually accessible for selective manual movement from a first, armed position to a second, actuating position to release said gas from the capsule;

an indicator structure visibly mounted on said inflator body and arranged within a manual movement path of said actuator structure from the first position to the second position in which said manual movement of said actuator member produces engagement and displacement of said indicator structure such that said displacement serves as indicia of said second actuating position of said actuator member and actuated release of said gas, wherein said indicator structure comprises a detachable member mounted on said inflator body in a pivotal path of a manual lever member defining said actuator member to enable detachment of the detachable member from said inflator body by pivot of said lever member thereagainst.

10. A gas inflator according to claim 9, wherein said inflator body comprises first and second recess portions positioned to receive removable insertion of respective coupling portions of said detachable member.

* * * * *

UNITED STATES PATENT AND TRADEMARK OFFICE

CERTIFICATE OF CORRECTION

PATENT NO. : 5,694,986

DATED : December 9, 1997

INVENTOR(S) : Jacek M. Weinheimer and Lyman W. Fawcett, Jr.

It is certified that error appears in the above-indentified patent and that said Letters Patent is hereby corrected as shown below:

On the title page, item [57],

Line 1 "An an inflator" should be -- An inflator --

On the title page, item [57],

Line 20 "indicatior" should be -- indicator --

Column 1, Line 58 "devices" should be --means --

Signed and Sealed this

Seventh Day of July, 1998

Bruce Lehman

*Attest:*

BRUCE LEHMAN

*Attesting Officer*

*Commissioner of Patents and Trademarks*